US008517193B1

(12) United States Patent
Small

(10) Patent No.: US 8,517,193 B1
(45) Date of Patent: Aug. 27, 2013

(54) COMBINATION LOCKING BOTTLE HOLDER

(75) Inventor: Steven Douglas Small, Novato, CA (US)

(73) Assignee: Steven Douglas Small, Novato, CA (US)

( * ) Notice: Subject to any disclaimer, the term of this patent is extended or adjusted under 35 U.S.C. 154(b) by 38 days.

(21) Appl. No.: 13/357,610

(22) Filed: Jan. 24, 2012

Related U.S. Application Data

(60) Provisional application No. 61/462,623, filed on Feb. 3, 2011.

(51) Int. Cl.
*A16J 1/00* (2006.01)
*B65D 55/02* (2006.01)

(52) U.S. Cl.
USPC ..... 215/206; 215/201; 215/208; 215/230; 70/58; 70/166; 70/312; 220/8

(58) Field of Classification Search
USPC ..... 70/57, 58, 63, 166, 167, 312; 206/459.5, 206/806; 215/201, 206–208, 230; 220/8, 220/686, 737, 739
See application file for complete search history.

(56) References Cited

U.S. PATENT DOCUMENTS 1,195,745 A * 8/1916 Snyder ..... 70/26
1,358,352 A 11/1920 Wheelock
3,405,828 A * 10/1968 St Pierre ..... 70/173
3,407,954 A * 10/1968 Millis ..... 215/206
3,445,021 A * 5/1969 Johnson ..... 215/206
3,684,117 A * 8/1972 Leopoldi et al. ..... 215/206
4,354,365 A 10/1982 Mayer et al.
4,445,348 A 5/1984 Saitoh
4,615,191 A 10/1986 Grandy
4,782,963 A * 11/1988 Hunter ..... 215/206
5,277,325 A * 1/1994 Yan ..... 215/206
5,284,262 A * 2/1994 O'Nan ..... 215/206
6,021,653 A 2/2000 Pimpo
6,059,132 A 5/2000 Benjamin
6,604,643 B1 8/2003 Michael et al.
6,621,405 B1 9/2003 Basche et al.
6,769,557 B2 8/2004 Michael et al.
7,107,803 B1 9/2006 Swanson
7,252,204 B1 8/2007 Small
7,600,648 B2 10/2009 Hamer
7,681,422 B2 3/2010 Tonaltzin
7,878,033 B2 2/2011 Fawcett et al.
8,020,415 B2 9/2011 Corbin et al.
8,328,031 B2 * 12/2012 Gonzalez Sanchez et al. ..... 215/206
2011/0210136 A1 * 9/2011 Wang ..... 70/63

* cited by examiner

*Primary Examiner* — Christopher Boswell

(57) ABSTRACT

A combination locking bottle holder is disclosed comprising a base, a locking bar, and a plurality of tumblers. When a bottle is locked inside the device, features limit access to and prevent removal of the bottle's closure. When the tumbler rings with external indicia are properly aligned to a marker and display a predetermined code, the mechanism permits extraction of the locking bar and allows the bottle to be removed.

8 Claims, 12 Drawing Sheets

FIG. 1-A
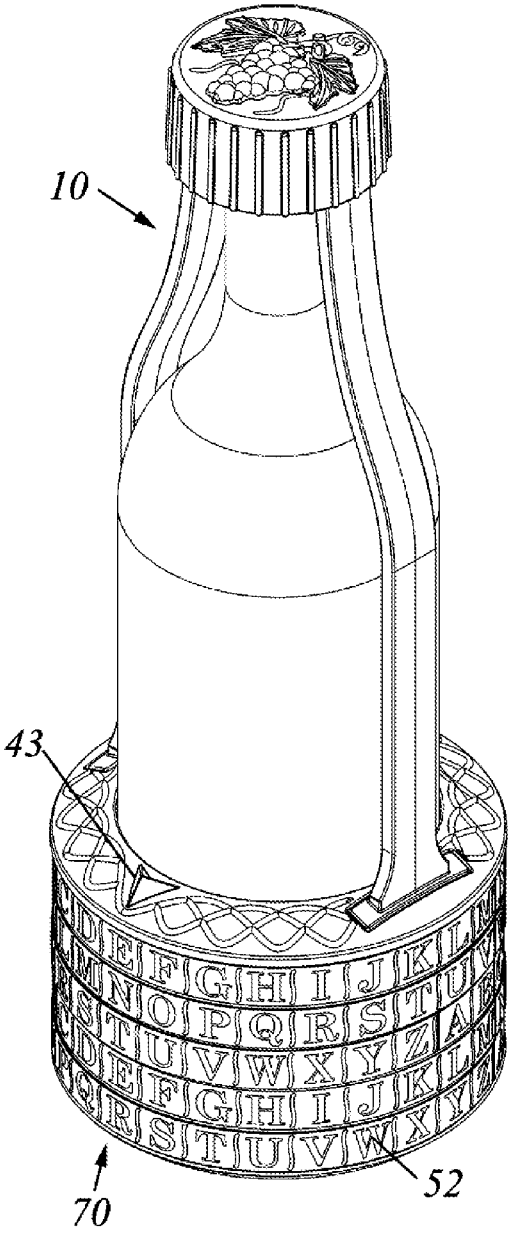
FIG. 1-B
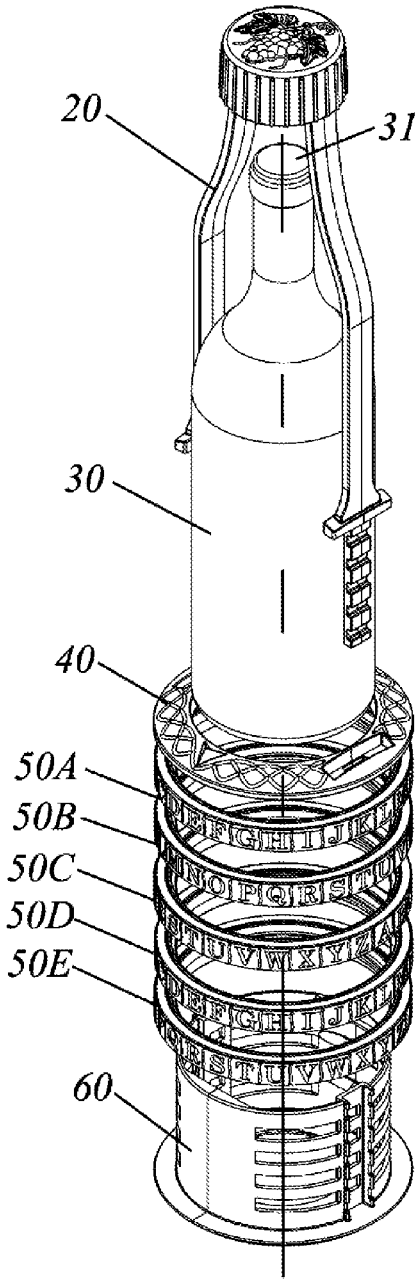

FIG. 2-A
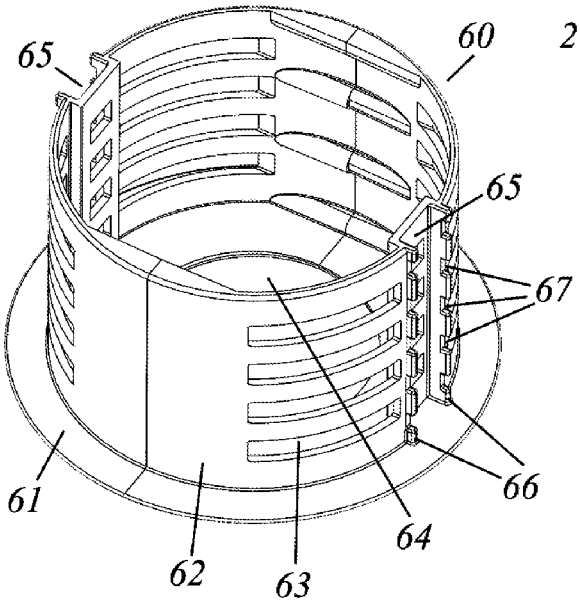
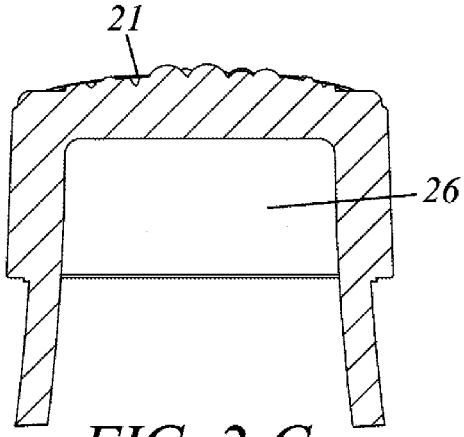
FIG. 2-C
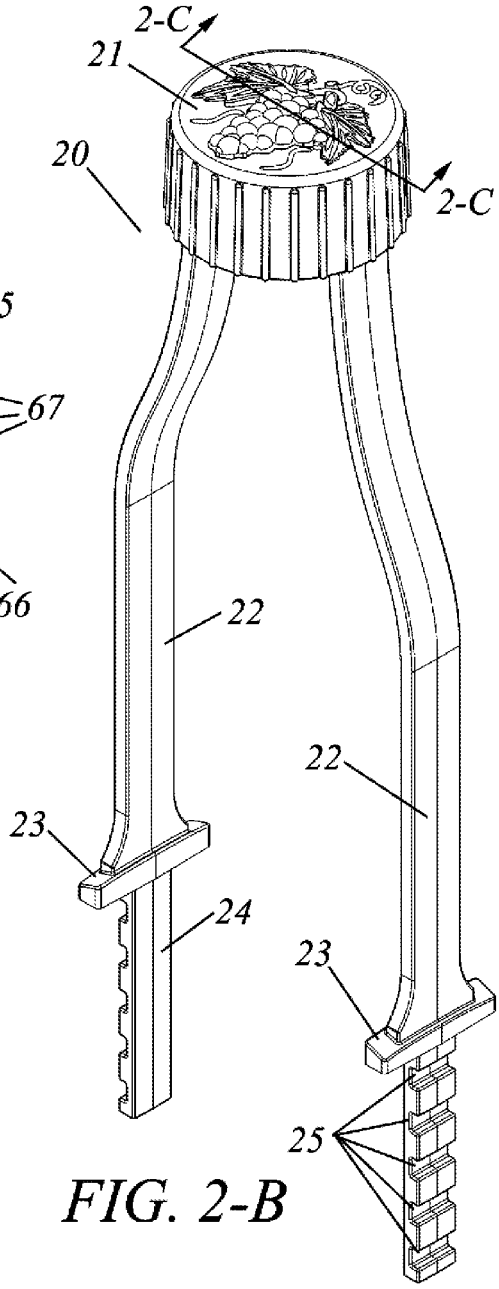
FIG. 2-B

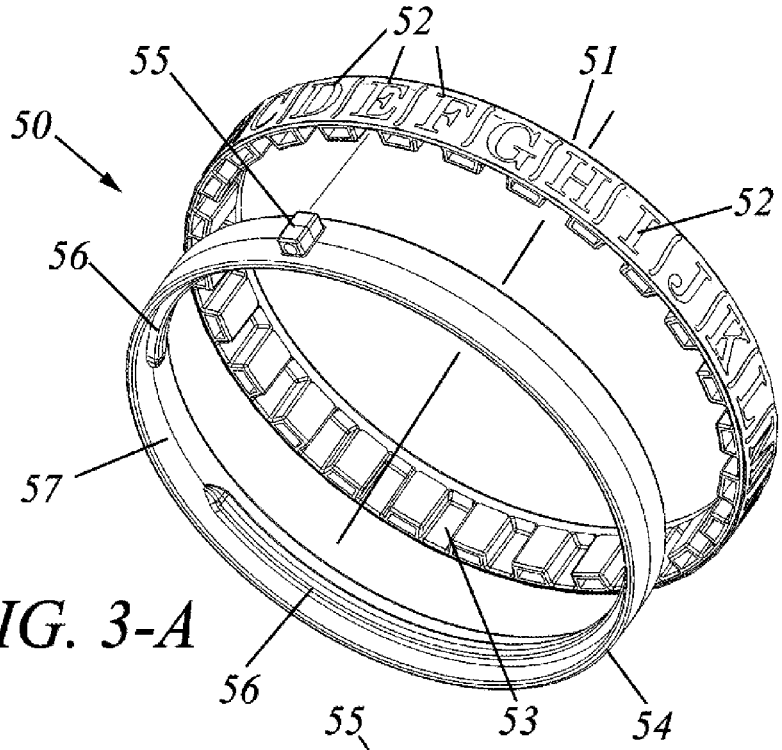
FIG. 3-A
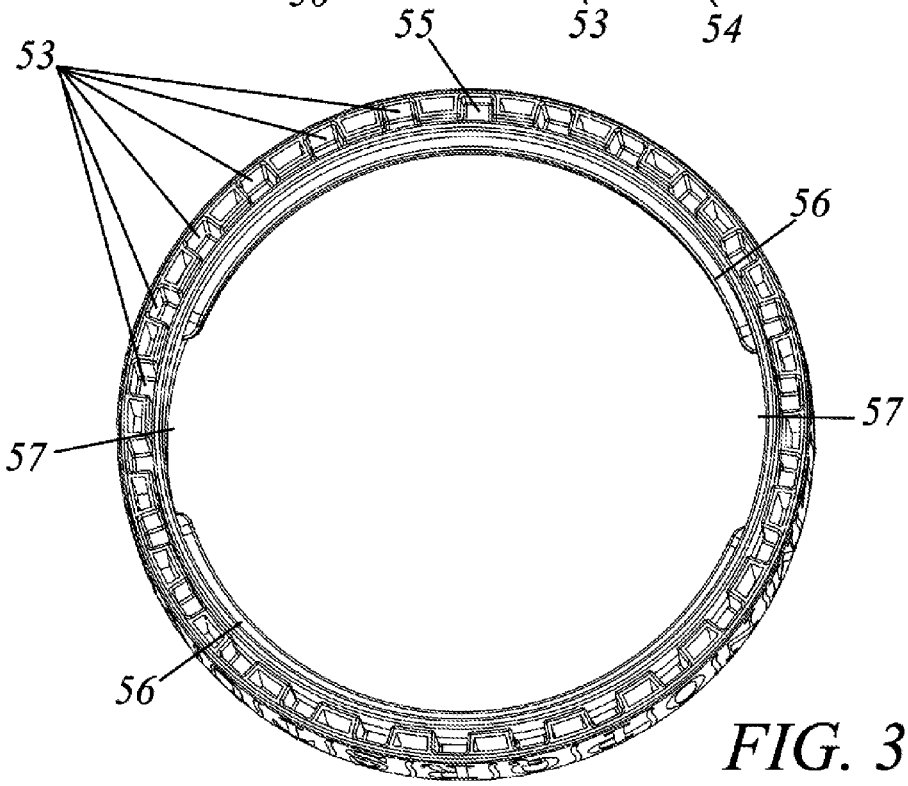
FIG. 3-B

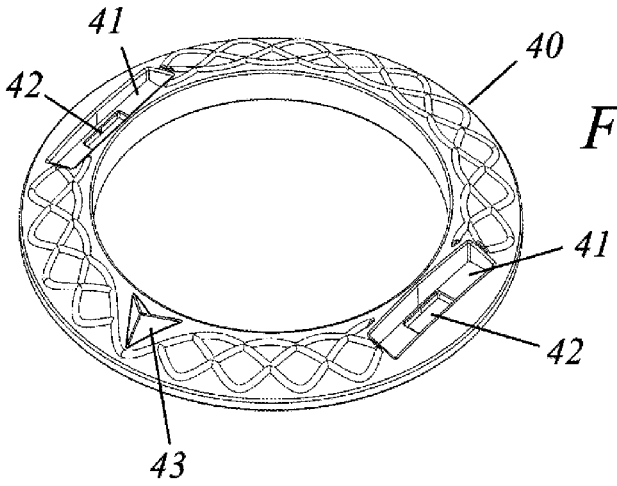
FIG. 4-A
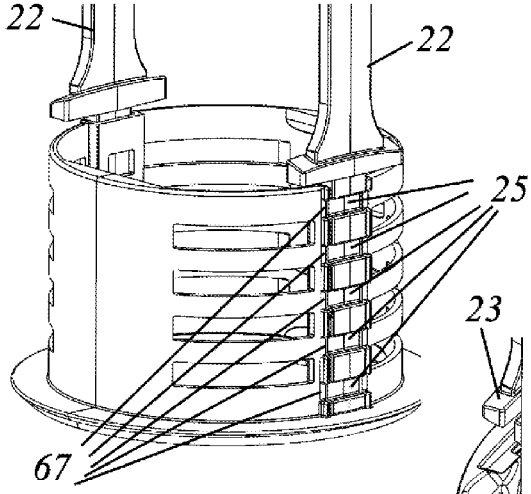
FIG. 4-B
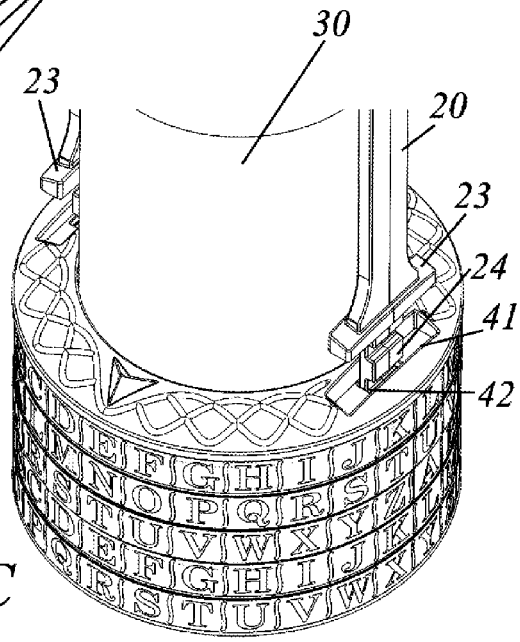
FIG. 4-C

FIG. 5-A
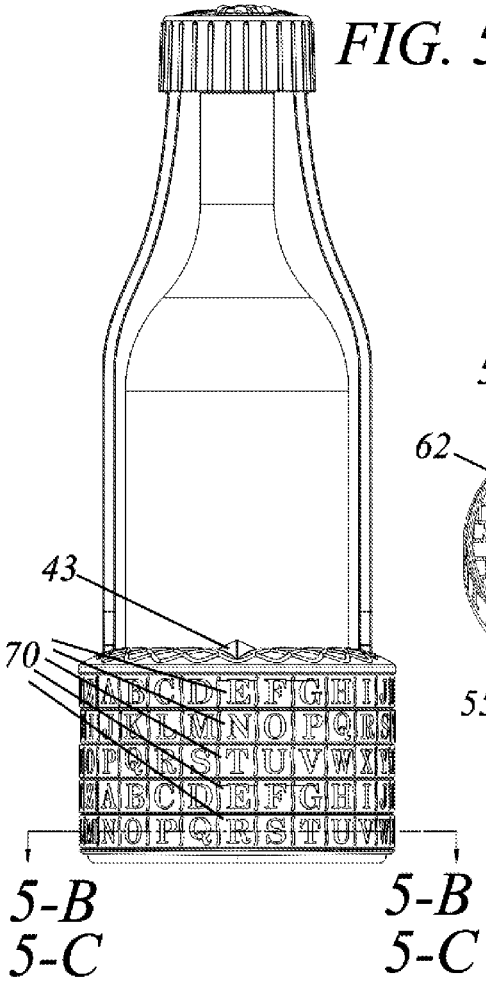
FIG. 5-B
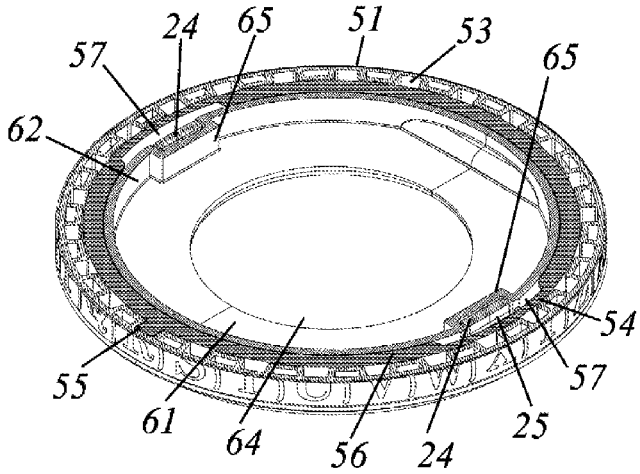
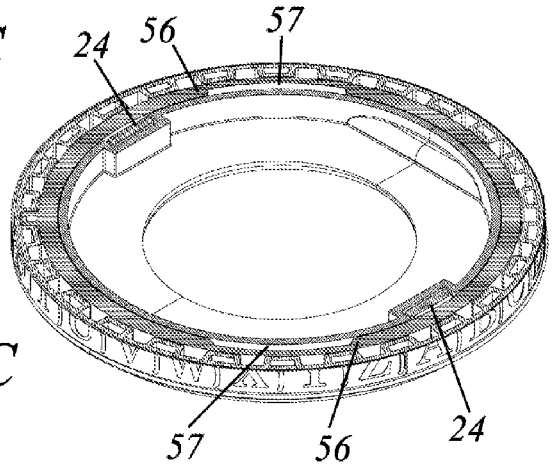
FIG. 5-C

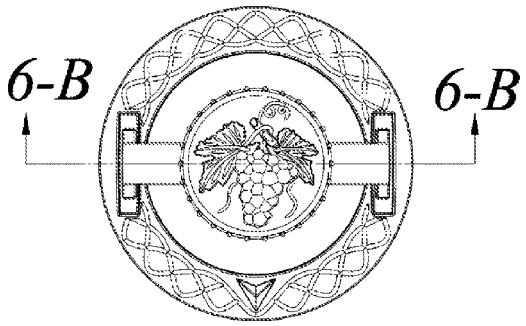
FIG. 6-A
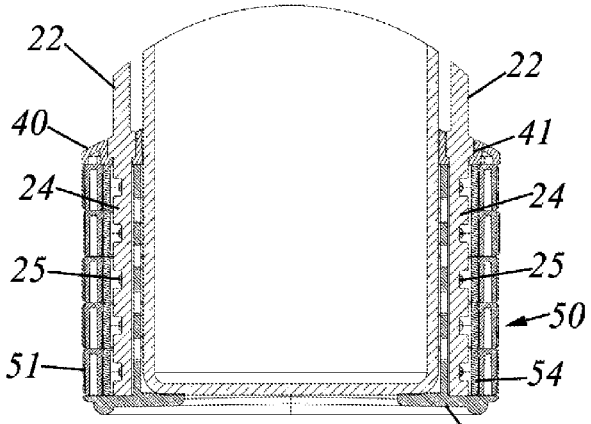
FIG. 6-C
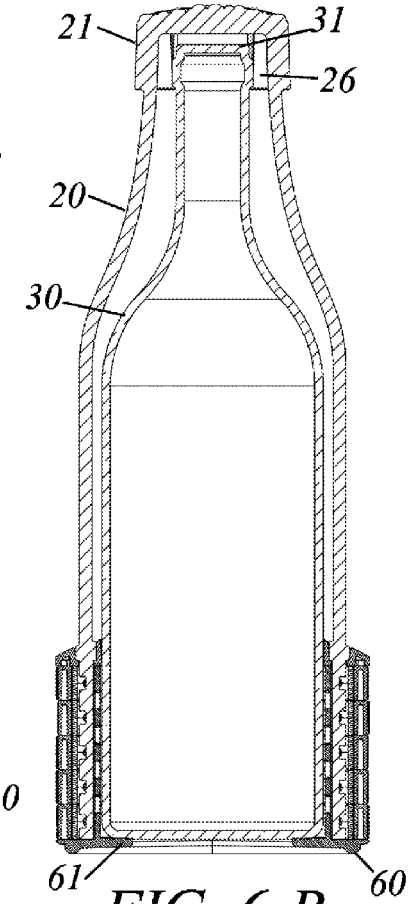
FIG. 6-B
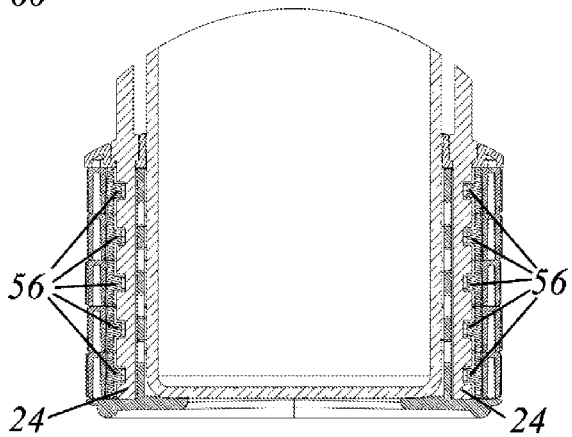
FIG. 6-D

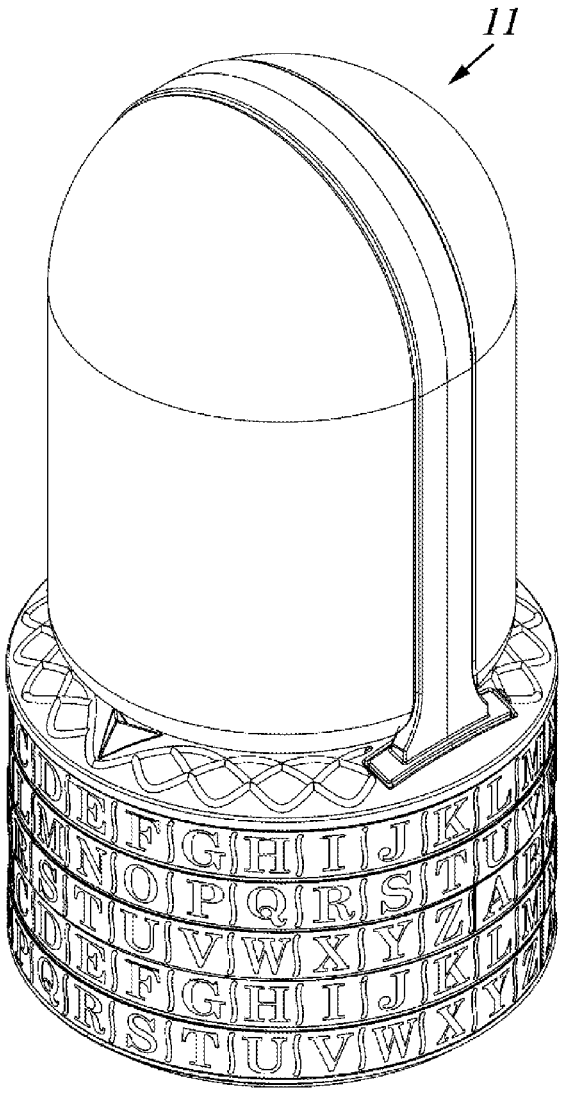
FIG. 7-A
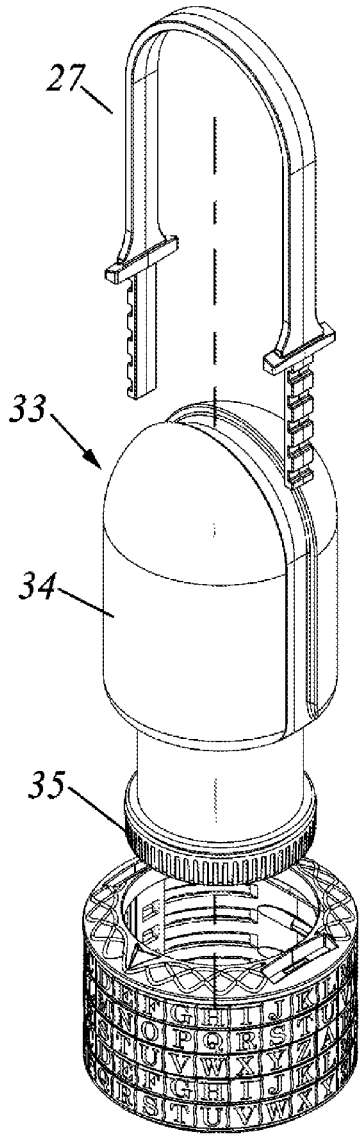
FIG. 7-B

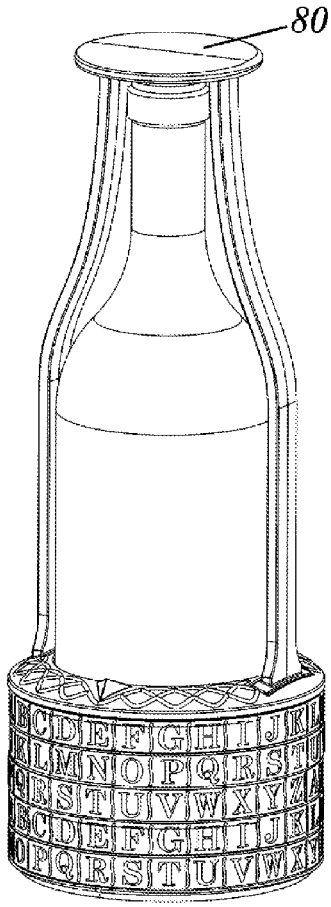
FIG. 8-A
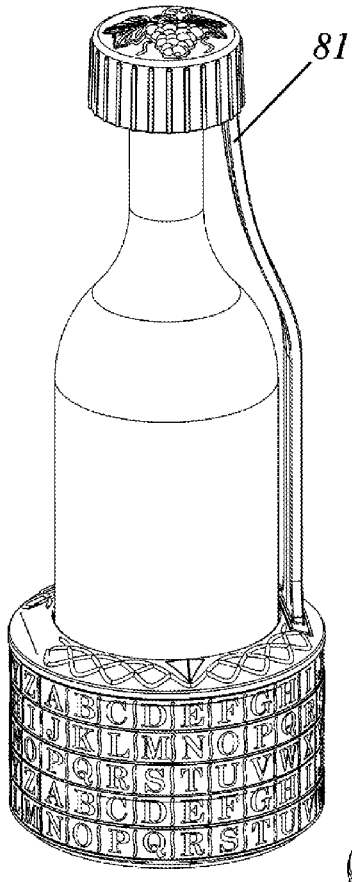
FIG. 8-B
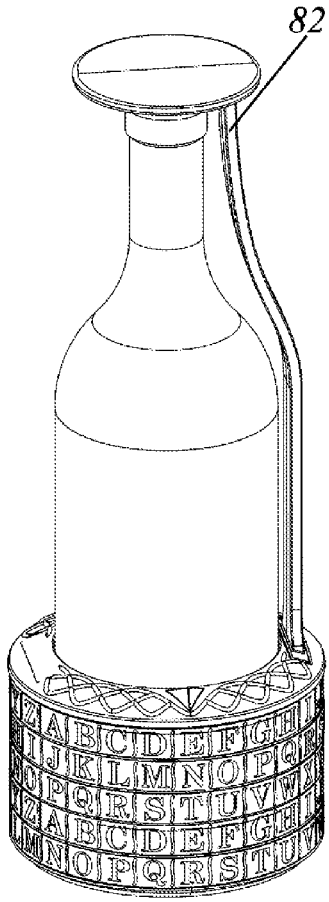
FIG. 8-C

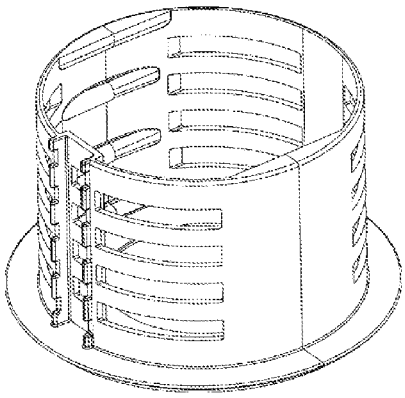
FIG. 9-A
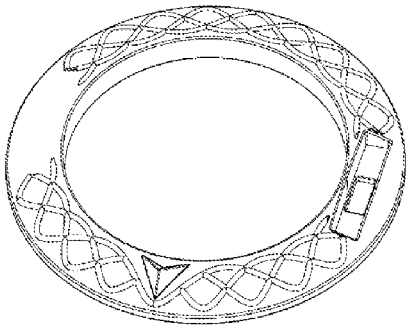
FIG. 9-B
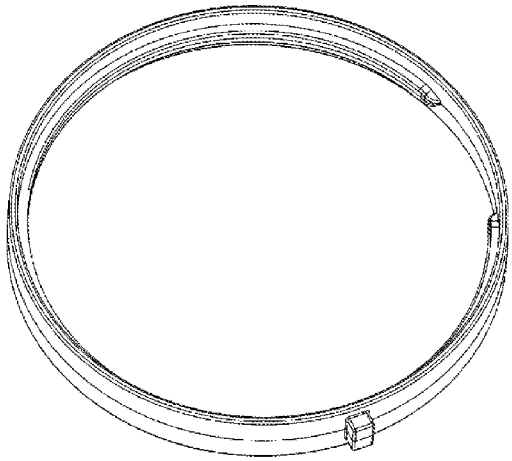
FIG. 9-C
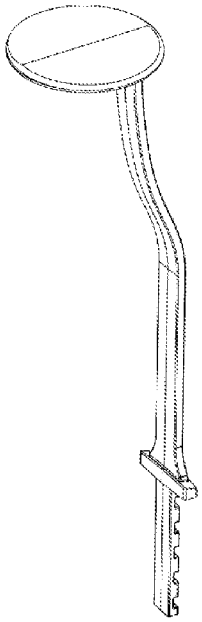
FIG. 9-D
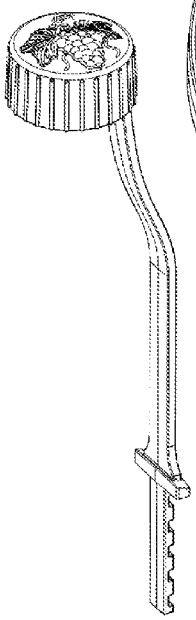
FIG. 9-E

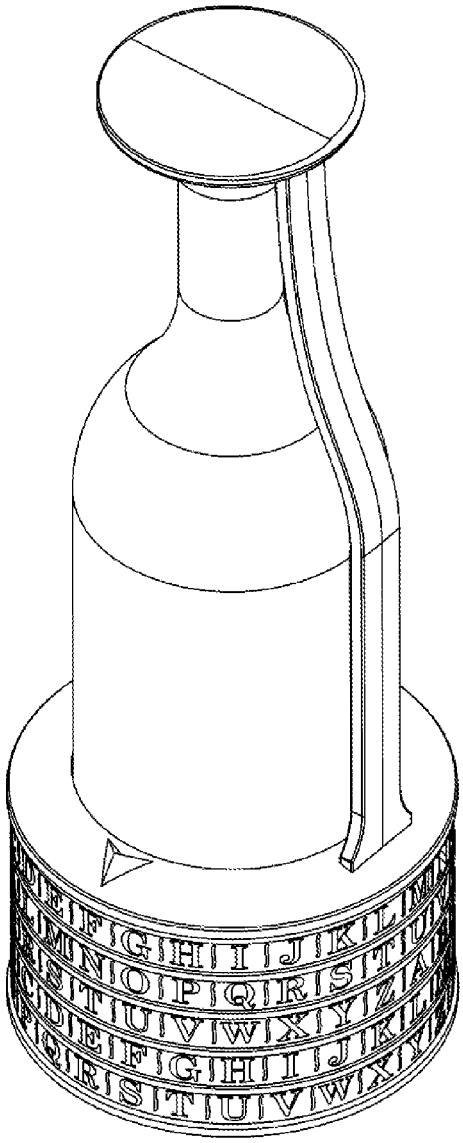
FIG. 10-A
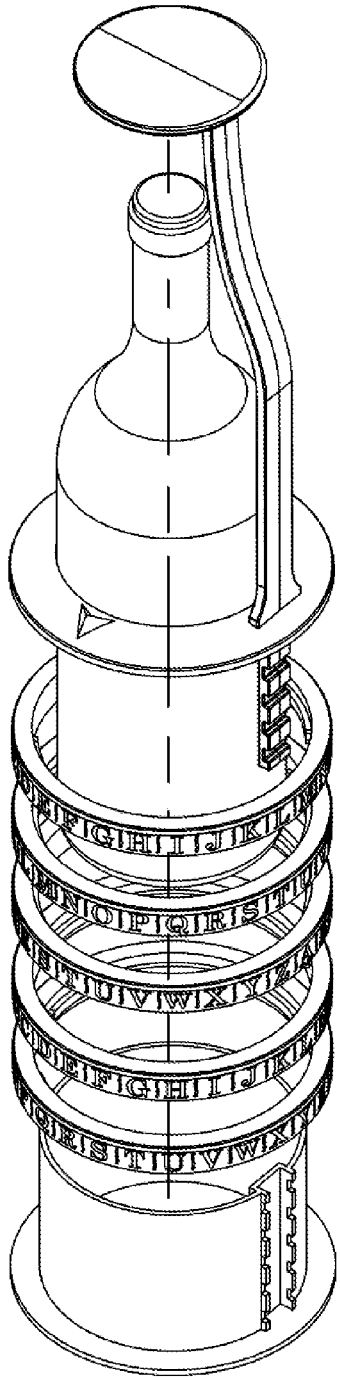
FIG. 10-B

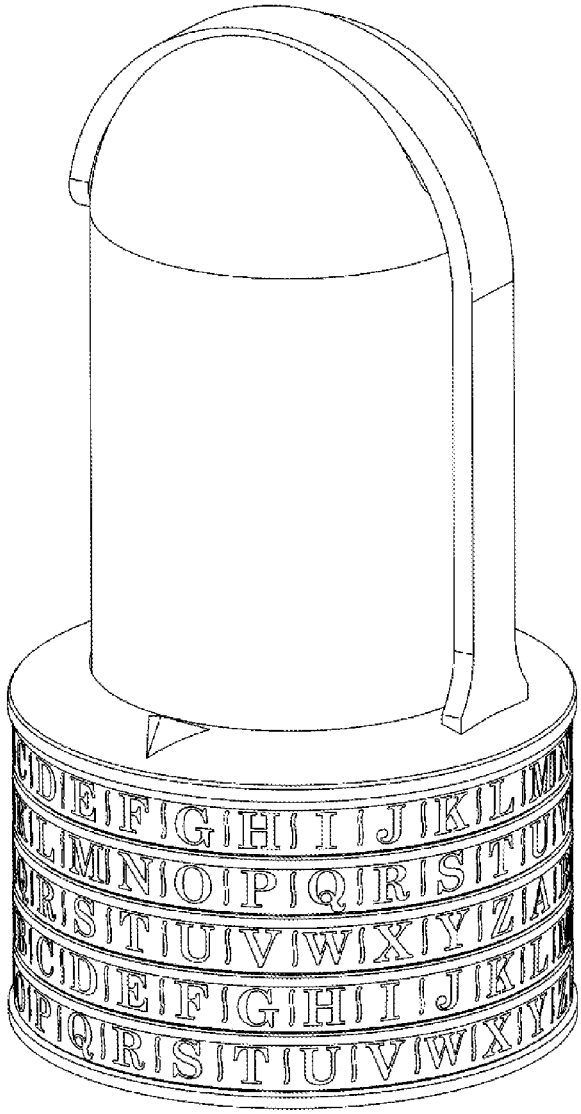
FIG. 11-A
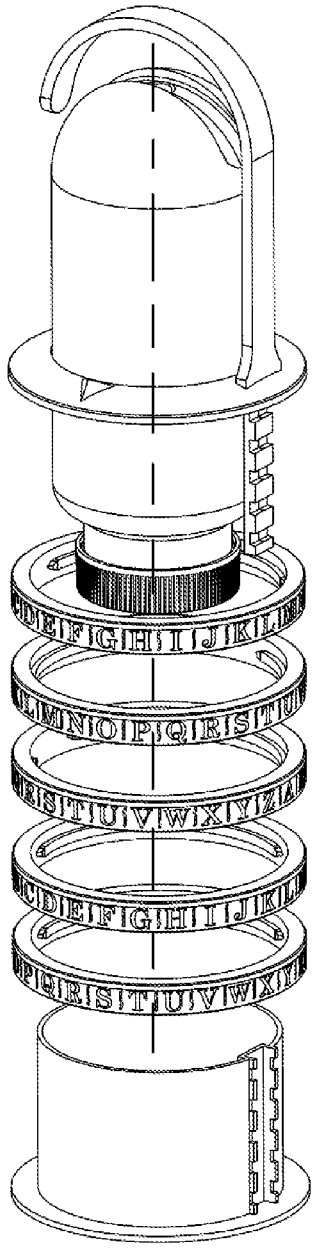
FIG. 11-B

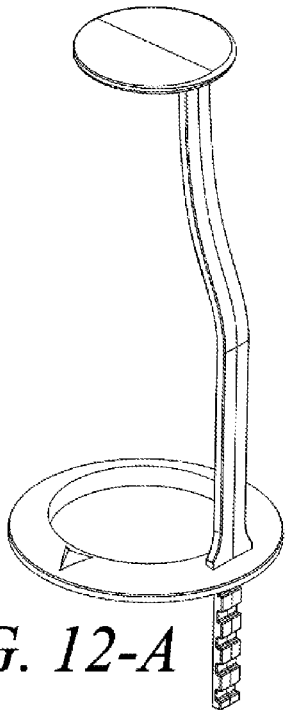
FIG. 12-A
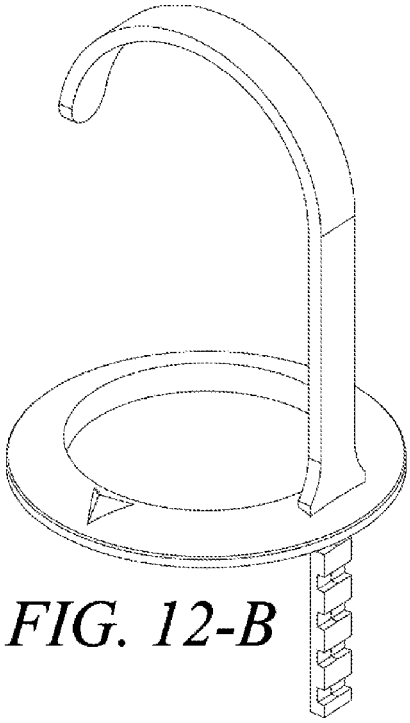
FIG. 12-B
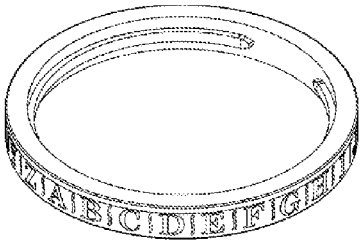
FIG. 12-C
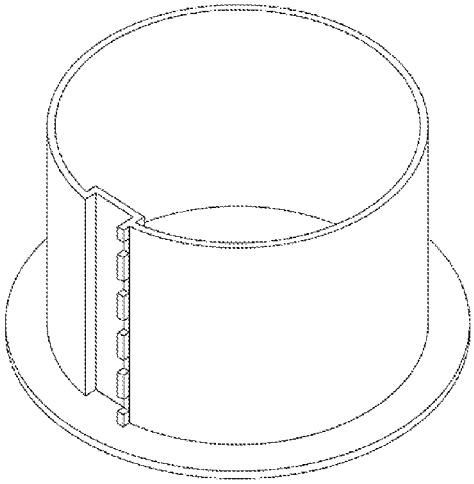
FIG. 12-D

COMBINATION LOCKING BOTTLE HOLDER

CROSS-REFERENCE TO RELATED APPLICATIONS

This application claims the benefit of U.S. PPA Ser. No. 61/462,623, filed 2011 Feb. 3 by the present inventor.

FEDERALLY SPONSORED RESEARCH

Not Applicable

SEQUENCE LISTING

Not Applicable

BACKGROUND OF THE INVENTION

1. Field of Invention

This invention relates to a combination locking device for bottles or containers.

2. Prior Art

The present inventor received a U.S. Pat. No. 7,252,204 in 2007 on a device that locks, or preventing the unauthorized opening, of typical 750 ml bottles. The device uses tumblers with indicia that, when aligned to a preset five letter code word, allows the lock mechanism to be opened and the entire bottle to be retrieved. The product is intended to be a novelty puzzle and game item however other permutations could extend its use into other commercial applications. After market research, it has been found desirable to add a design version with features that would allow the simple resetting of the locking combination tumblers. Likewise, it was found to be equally as important to change the overall assembled construction to reduce the amount of materials used in manufacture, lower overall cost, while at the same time keeping the number of required parts to a minimum. In addition, other research has indicated that a market exists for the device to be used in the exchange of gift items, other than wine or spirits. It is the intent of this present invention to produce a new and improved device by reconfiguration of the parts, mechanism, and method of assembly.

There are a number of inventions and products on the market related to securing the contents of bottles. "Bottle Security Device" to Fawcett et al. U.S. Pat. No. 7,878,033, "Bottle Cap with Combination Lock" to Hamer U.S. Pat. No. 7,600,648 and "Combination Locking Cap for Containers and Threaded Openings" to Benjamin U.S. Pat. No. 6,059,132 both show devices that lock the tops of bottles. The "Bottle Lock Liquor Locker", patent status unknown, (manufactured by Franklin Machine Products) is a bottle stopper that has three combination dials that when properly aligned will allow removal of the stopper. U.S. Pat. No. 1,358,352 to Wheelock (1920) shows another combination locking closure for an open bottle. Other locking devices that both attach to the bottles and act as theft deterrents are described in US Patent Application US 2006/0043050 A1 to Beldon, Jr. (2006) and U.S. Pat. No. 6,604,643 & 6,769,557 to Michael et al. (2003 & 2004).

There are many patented combination locking devices that allow users to set up or allow permutation of the combinations code. Most involve altering or resetting the tumblers indicia (such as numbers, letters, or symbols) relative to the tumbler internal keyway. Such devices are generally found and more closely related to the field of locks and in particular bicycle cable locks and padlocks. Most of the locking devices in which the combination may be set by an individual tend to be complex in nature and have many mechanical parts such as in European patent application of Nagata, EP 43859 A1 1/1982. U.S. Pat. No. 6,021,653 to Pimpo (2000) shows a tumbler ring that can be disassembled and have individual indicia plates applied into external slots. U.S. Pat. Nos. 4,615,191, 4,445,348, and 4,354,365 show several variations of two piece tumbler assemblies that allow inner and outer tumblers to have variable radial positions for changing the code. U.S. Pat. No. 6,059,132 to Benjamin describes a combination locking cap that uses flat circular labels to apply indicia. U.S. Pat. No. 6,621,405 B1 describes as word system and computer algorithm for determining a limited set of useable code words for a combination lock. U.S. Pat. No. 7,107,803 B1, shows a locking cylinder. U.S. Pat. No. 8,020,415 to Corbin et al. shows a combination locking pill bottle. U.S. Pat. No. 7,681,422 to Tonaltzin shows a locking gift box with programmable timer.

3. Objects and Advantages

It is the object of the present invention to provide a combination locking bottle holder that has the following advantages which are:

(a) to provide a device that can lock any bottle or container with a cap or closure;

(b) to provide a unique and novel puzzle product that can be used to exchange wine, spirits, or other gifts and likewise could be used as a money bank;

(c) to create a bottle locking device that is easy to manufacture for high volume production;

(d) to create a bottle locking device that requires the fewest number of unique parts and which uses a minimum amount of materials (e) to provide a device that has a version which permits easy recombination of the locking code;

Still further objects and advantages will become apparent from a consideration of the ensuing description and drawings.

SUMMARY

The present invention provides a combination locking bottle holder. The device can have several embodiments that are suitable for different applications. The invention could be designed minimal parts for use with just one preset combination code or be configured with additional parts used that would allow for multiple resetting of the combination.

One embodiment of the invention is for use as a puzzle in a treasure hunt/clue based game for the exchange of 750 ml wine or spirits bottles. The construction or scale of the device may be altered for use with taller height or larger diameter bottles outside of the standard 750 ml bottle size range—for example magnum bottles, champagne, cognac, liqueurs, etc.

The invention may also be used with other non-alcoholic related containers of various profile sizes and shapes. The locking bar used for retention of the bottle may be sized and shaped to follow the profile or contour of any size or shape container. The container can be suitably sized and have a large enough cap or closure to accept gift items inside such as cigars, jewelry, confections, money, etc. As mentioned, the scale and shape of the device could be altered for larger items retained. When installed and locked in the device, a closure or cap of a container may be located at either top or bottom end of the device. Installed in either orientation, the container is captured and its closure is inaccessible and cannot be removed. With a slot in the container's closure, one embodiment could allow it to be used as a coin or money bank. A commercial use of the device, as an example, might include limiting access to bottles of prescription medicines in a pharmacy for example.

Design features of some of the embodiments include an easy method for resetting or changing the combination code word with two piece tumblers. The invention is not limited to just five tumblers and five letter words. The device could be configured to take any number of locking tumblers. This would permit the use of combination codes that could be greater or less than five characters in length. Besides the English alphabet, other international language alphabets, characters, or symbols could be used as indicia on the outside of device's tumblers.

Briefly, the principal upon which the locking mechanism is based calls for the alignment of a set of tumblers on a cylindrical base that permit the insertion and extraction of a locking bar. The cylindrical base has an inside diameter that can accept a bottle. The tumblers have locking rib features that align with, intersect, and engage a series of notches in both the base and bar. The locking rib has at least one break, or open gap, in its circumference. Engagement or intersection of the tumbler's locking ribs into the notches of the base and bar are what lock the base and bar together. The bar has an integral portion that covers or wraps around the upper exposed end of the bottle or container and which prevents its removal. The bar also has an integral ring shaped portion that covers and captures the tumblers. This ring shaped portion of the bar prevents removal of the tumblers when the bar is locked into the base. When installed and locked into the device, the cap or closure of the bottle is inaccessible and cannot be removed, thus the contents of the bottle are secured. A bottle may be oriented with its closure nearest the top end of the device or upside down where the closure is inside of the base. The tumblers have indicia on their circumference. When these indicia are correctly aligned with a marker to spell out a predetermined code word, the gaps within the tumbler's locking ribs are aligned and coincide with the notch features of the bar and base. In this state, the bar be inserted or extracted from the base and tumblers, whereby the retained bottle may also be accessed.

BRIEF DESCRIPTION OF THE DRAWINGS

FIGS. 1-A & 1-B show the first embodiment in assembled and exploded views.

FIG. 2-A is a view of the base.

FIG. 2-B is a view of the locking bar.

FIG. 2-C is a partial cross section of the cap portion of the locking bar.

FIG. 3-A is an exploded perspective view of inner and outer ring of the tumbler set.

FIG. 3-B is a view of the inner ring nested into the outer ring of the tumbler set.

FIG. 4-A is a view of the upper ring.

FIG. 4-B shows the bar engaged into side channels of base.

FIG. 4-C is an exploded view of bar engagement into upper ring.

FIG. 5-A shows an elevation view of the locking bottle holder.

FIG. 5-B shows a section view through a tumbler positioned in an unlocked condition.

FIG. 5-C is a section view through a tumbler positioned in a locked condition.

FIG. 6-A is a top view of the locking bottle holder.

FIG. 6-B is an elevation section view of the locking bottle holder.

FIG. 6-C is a detailed section view of tumblers set in to an unlocked condition.

FIG. 6-D is a detailed section view of tumblers set in to a locked condition.

FIG. 7-A is a view of an alternative embodiment locking bottle holder.

FIG. 7-B is an exploded view of an alternative embodiment locking bottle holder.

FIG. 8-A is a perspective view of an alternative locking bar with flat portion at the top.

FIG. 8-B is a perspective view of an alternative locking bar with single leg and a cap portion.

FIG. 8-C is a perspective view of an alternative locking bar with single leg and a flat portion.

FIG. 9-A is a view of the base for single leg locking bar.

FIG. 9-B is a view of the upper ring for single leg locking bar.

FIG. 9-C is a view of the inner ring for single leg locking bar.

FIG. 9-D & E are views of single leg locking bars.

FIG. 10-A though 11-B show embodiments with single leg bar with integrally formed ring, single piece tumblers, and a base with a single channel.

FIG. 12-A & B show two embodiments of the single leg bar with integrally formed ring feature FIG. 12-C shows single piece tumbler, with one gap in locking rib and external indicia.

FIG. 12-D shows the base with a single channel and one notched rib.

REFERENCE NUMERALS

| | |
|---|---|
| 10 | combination locking bottle holder |
| 11 | alternative embodiment of combination locking bottle holder |
| 20 | locking bar |
| 21 | cap portion of bar |
| 22 | leg |
| 23 | boss feature |
| 24 | lower leg portions of bar |
| 25 | notches of lower portion of bar leg |
| 26 | hollow portion of bar cap |
| 27 | locking bar for a container |
| 28 | locking bar with single leg |
| 30 | bottle |
| 31 | bottle closure |
| 33 | container |
| 34 | container bottle |
| 35 | container cap |
| 40 | upper ring |
| 41 | counterbored of upper ring |
| 42 | rectangular opening in counterbore |
| 43 | alignment marker |
| 50 | tumbler sets |
| 51 | outer ring |
| 52 | indicia of outer ring |
| 53 | outer ring recesses |
| 54 | inner ring |
| 55 | protruding tooth of inner ring |
| 56 | annular locking rib of inner ring |
| 57 | gaps of inner ring locking rib |
| 60 | base |
| 61 | bottom flanged portion of base |
| 62 | cylindrical wall of base |
| 63 | cut outs in cylindrical wall of base |
| 64 | opening on bottom flange of base |
| 65 | recessed side channels of base |
| 66 | longitudinal ribs of base channels |
| 67 | notches of longitudinal ribs on base |
| 70 | code word |
| 80 | locking bar with top planar portion |

-continued

| | |
|---|---|
| 81 | single leg locking bar with cap |
| 82 | single leg locking bar with flange |

DETAILED DESCRIPTIONS

The following descriptions and drawings illustrate various embodiments. There is no single preferred embodiment. Each has advantages depending upon its intended use and application. Each embodiment may require different materials or need be sized to provide greater mechanical strength or rigidity. The drawings and descriptions below do not imply or suggest any specific dimensions, wall thickness, or materials. For example, some embodiments could be suitable for production in injection molded plastics where as others might require stronger, more rigid materials such as die cast or machined metals. Likewise exact values for fits, allowances, tolerances, etc. are not specified.

First Embodiment FIGS. 1-A Through 6-D

A first embodiment of a combination locking bottle holder of the present invention is illustrated in FIGS. 1-A through 6-D. FIGS. 1-A & 1-B show the combination locking bottle holder 10 consisting of a locking bar 20, an upper ring 40, five tumbler sets 50A-50E and a base 60. The embodiment shown in both FIG. 1-A & FIG. 1-B show that the holder can accept a standard 750 ml wine bottle 30 with a bottle closure 31. Scale or size of the device could be varied to fit alternative bottle shapes—which might include a custom bottle, or champagne, cognac, and magnum sized bottles for example. The embodiment shows use of five tumbler sets, however, fewer or great number of tumblers could also provide the locking function. An alignment marker 43 is formed on an upper ring 40 for alignment of indicia 52 beneath. Tumblers positioned such that the indicia are properly aligned beneath the marker and spell out a preset code word 70 place the holder in an unlocked condition. In the unlocked condition, the locking bar may be removed and the bottle accessed. In FIG. 1-A the indicia shown beneath the marker spell out the code word "ENTER".

FIG. 2-A shows a view of the base 60. The base consists of an upright cylindrical portion 62, with a bottom flanged portion 61 extending both inwardly and outwardly from the bottom edge of the cylindrical portion. Inner portion of flange results in a hole or opening 64 on the bottom wall. This opening is not significant, as its purpose serves just to reduce material used, i.e. the bottom end of the cylinder could be completely closed off. The diameter of the flange extending outside of the cylindrical portion is approximately equal to the outer diameter of the tumbler sets. The base's inside bottom wall retains and vertically supports any bottle placed inside. The flange functions as a seat for the stacked tumblers. The sum height of the stacked tumblers is equal to or just less than the length of the base's cylindrical portion above the flange. Two recessed side channels 65 are inwardly formed and are positioned directly opposite each other on the cylindrical wall. The open channels shown here have walls that meet perpendicularly to each other or create an open rectangle. Many other channel profiles are possible. A semi-circular, semi elliptical, dove-tail slot, etc could all be potentially used. The open rectangular channels shown in this embodiment have short longitudinal ribs 66 that extend outwardly from the cylinders diameter. A series of five notches 67 are formed into each longitudinal rib at specific heights above the flange. Note that these notches engage with the locking ribs of the tumblers and are in vertical alignment with the notches of the installed locking bar—which be discussed shortly. The cylindrical wall of the base also has several cut outs 63 that serve no purpose other than to reduce usage of material.

FIG. 2-B shows one embodiment of a locking bar 20 that has an integrally formed cylindrical cap portion 21 of nominal wall thickness that is closed on the top end and open on the bottom side as shown in FIG. 2-C. With the device assembled around a bottle, the inside diameter and depth of the bar's cap hollow portion 26 are large enough to sufficiently surround and conceal the closure of a bottle. Formed beneath the bar's cap portion are two legs 22 extending in a general downward vertical direction. The cross-section shown in this embodiment is generally rectangular. Other cross-sections profiles such as cross, oval, elliptical, and circular could alternatively be used. The portion of bar could easily be formed or forged out of metal bar or wire. Shown here, the bar's upper leg portions aesthetically curve to generally follow the contour of a typical 750 ml bottle. This bar profile could be varied for some other curvature or even be straight. At the mid-portion of each leg is a protruding boss feature 23. The boss features shown in this embodiment are generally rectangular in shape with a planar bottom and curved upper surface. Other shapes for the boss are possible such as short cylindrical or elliptical protrusions among others. Extending vertically downward beneath each boss is a lower leg portion 24 each having a rectangular cross-section. The rectangular lower leg is sized to fit into the channels of the base. On the outward facing surfaces of each lower leg is a series of five formed notches 25. These notches are at specific heights above the leg end and are intended to be in vertical alignment or equal elevation with the base notches when assembled. Similar to the aforementioned channel, the lower leg portions could have an alternate cross-sectional shape to match and be accepted into the channels, circular, oval, etc. Note that the length of the lower leg portion, beneath the boss, is equal to or just greater than the length of the base's cylindrical portion above the flange. Also note that the center-to-center spacing between the two lower legs is equal to the center-to-center spacing of the channels on the base.

FIGS. 3-A & 3-B show a tumbler set 50. The tumbler set consists of an inner ring 54 and an outer ring 51. Both rings are equal height and cylindrical in shape. The inner ring has a single rectangular tooth 55 protruding from its outside diameter. A short annular locking rib 56 protrudes radially inward from the inside surface of the inner ring. The locking rib is on a midplane, or centered in height, with respect to the part. The locking rib's vertical height is just slightly less than the vertical height of the notches in both the base and the locking bar, into which it engages. The inner annular surface of locking rib defines the inside diameter of the tumbler. The tumbler's inside diameter is just slightly greater than the outside diameter of the base's cylindrical portion. Thus, tumblers have a close clearance diametral fit with the base and can freely rotate around the base cylinder. The locking rib is not continuous, but rather it's circumference is broken in two places. These two gaps 57 are directly opposite from each other. The tooth is oriented at ninety degrees away from either gap. The width of these gaps is just greater than the width of each channels formed in the base. The gaps act as a keyway and permit the tumblers to be assembled onto the base, over the cylinder and channels. When the tumblers are stacked onto the base, and the gaps are aligned with the channels such that no portion of the locking rib is in engaged in the channel, the locking bar may be inserted or extracted. This is defined to be the unlocked condition.

The outer ring 51 has indicia 52 on the outside diameter surface. The present embodiment uses the English alphabet with twenty-six letters. Other design variations with a different number of letters could be designed for Chinese or Hebrew language for example. The indicia could also be numbers or symbols. Behind each of the twenty-six letters, and formed on inside surface of the outer ring, are twenty-six recesses 53 that are suitably sized to accept the tooth of the inner ring. Both inner and outer rings can concentrically nest together as shown in FIG. 3-B to form a tumbler. With the tooth feature able to fit and index behind any of the letters, the tumbler may be set to use any one of the letters as part of the unlocking code word. Recombination simply requires disengaging the tumbler set and re-indexing the tooth of the inner ring behind a new chosen letter the outer ring.

FIG. 4-A shows a perspective view of upper ring 40. The upper ring's outside diameter is approximately equal in size to that of the tumblers and to the lower flange on the base. The bottom surface of the upper ring is planar. The upper ring's inside diameter is large enough to accept a standard 750 ml bottle to pass through. Formed near the peripheral edges and opposing one another are two counterbored openings 41. Each counterbore has a rectangular opening 42 which is sized to allow the passage of the locking bar's notched lower legs. Spacing between the two counter bored openings is equal to the spacing of both the bar legs as well as the base channels. An alignment marker 43 is formed toward the peripheral edge of the upper ring and is centered between counterbores—it is positioned at ninety degrees orientation from either counterbored opening. It is with this marker that the code word indicia are aligned when setting the unlocked condition. FIG. 4-C shows that the size of the counterbored pocket is sufficiently sized to accept the bar's boss features 23. FIG. 4-B is shows the locking bar fully inserted into the channels of base with no other components shown. Note that the notches of lower portion of the bar legs are in exact vertical alignment with notches of longitudinal ribs 67 of the base.

FIG. 5-A is and elevation view of the embodiment showing a sample code word 70 "ENTER" aligned with the marker. FIG. 5-B is section view in perspective taken though the lower most tumbler. This view shows the orientation of the parts when the tumbler is set to the unlocked condition. As shown, the gaps in the locking rib of the inner ring are centered over the recessed side channels of the base. The inner ring locking rib is not engaged in the notches of either bar or base or in the base channel. The locking bar may be freely inserted or extracted. The tooth of the inner ring is shown engaged in the outer ring recess for the letter "R". FIG. 5-C shows the tumbler rotated to a locked condition where locking rib engaged into the bar and base notches, thus locking or preventing withdrawal of the bar from the base.

FIG. 6-A is a top view of the embodiment. FIG. 6-B is and elevation section view of the embodiment with bottle inserted. Note that in a locked condition, the bottle is captured and retained between the bottom flanged portion of base and the locking bar cap. FIG. 6-C shows a detailed elevation section though the tumblers in an unlocked condition. The locking ribs of inner rings are not engaged in the bar or base. FIG. 6-D shows a detailed elevation section though the tumblers in a locked condition. The locking ribs of inner rings are engaged and intersect into the lower leg portions of bar and into longitudinal ribs of the base channels. Note that in a locked condition, the bar stops prevent the upper ring and tumblers from being removed.

Second Embodiment FIGS. 7-A & 7-B

FIGS. 7-A & 7B show an alternative embodiment 11 where the container 33 is not related to wine or spirits and is oriented in a reverse direction—the container cap 35 positioned on the bottom. The locking bar for the container 27 is shown to follow the shape and contour of the container bottle 34. This embodiment permits the hold to secure a variety of items which could include, but are not limited to, small gifts, coins, money, jewelry, cigars, medicine, etc. Larger sizes for could accommodate other items. The cap could also easily have a slot that would accept coins or bills such that in yet another embodiment it could be used as a vault/coin or money bank.

Alternative Embodiments FIG. 8-A Through FIG. 12-D

FIG. 8-A shows an embodiment of a locking bar with an integrally formed top planar portion 80 as the means for retaining the bottle to the holder. The flat portion extends outward horizontally from the top of the bar and serves the same function as the cap portion of the bar previously described. With the bar locked, the flange portion traps the bottle inside the device and prevents removal or access to the cork or bottle cap.

FIGS. 8-B and 8C show an embodiments using a single leg locking bar with an integrally formed cap 81 and single leg locking bar with integrally formed flange 82 both functioning to retain the bottle and limit access to its closure. Note that in a single leg embodiment it may be required to use a material with greater mechanical strength such as a die cast metal, steel, or similar for the locking bar. Likewise a bar with a greater cross-section might be required to provide sufficient stiffness and rigidity to resist bending or deflection.

FIGS. 9-A thru 9-E show the part configurations for use of the device with a single leg bar embodiment. In this embodiment, only one leg would be required to lock the bar to the base instead of two. The number of features required to provide the locking mechanism would be reduced. Shown in FIG. 9-A the base would have just a single channel. Shown in FIG. 9-B the upper ring has one counterbore pocket and opening for the bar's single leg. FIG. 9-C shows that the inner ring of the tumbler would require just one gap in the locking rib. Shown in FIGS. 9-D & 9-E are both single leg locking bars with either flange or cap integrally formed at top end.

FIGS. 10-A and 10-B show a further simplified embodiment of the device using the least number of parts. This embodiment shows the upper ring as an integral portion molded or formed into the bar instead of being a separate part. The base is again shown to have just one channel for accepting the single leg of the bar. Shown are a set of five single piece tumblers with external indicia. In this version both inner and outer rings of the previously described tumbler set are merged together into one piece. This embodiment would permit locking of a container, but would permit just one set code word without the recombination capability.

FIGS. 11-A and 11-B similarly show a simplified version of the device for use with a custom container. Again the elements of the invention would be reduced to just a locking bar, five tumblers, and a base.

FIGS. 12-A through 12-D show the components used in the simplified embodiment. FIGS. 12-A and 12-B show the bar used for wine bottle or gift container versions respectively. FIG. 12-C shows the single piece tumbler with just one gap in the locking rib. FIG. 12-D shows that the base features could be further reduced and simplified and utilize just a single longitudinal rib with one set notches adjacent to the channel for locking with the bar and tumblers. The previously described embodiments have shown use of two ribs on either side of the channel.

CONCLUSION, RAMIFICATIONS, AND SCOPE

Accordingly, the reader will see that the combination locking bottle holder of this invention can secure the contents of any number of various shaped and sized bottles and containers. It can be easily set up and used as a novel game/puzzle for wine bottles or used to secure gifts and other items. Its simplest embodiment relies upon just three basic elements to function: a base, a set of tumblers, and a locking bar. One embodiment, where the tumbler uses an inner and outer ring set, allows the code word combination to easily be changed. Although the description above contains many specifications, these should not be construed as limiting the scope of the invention but as merely providing illustrations of some of the various embodiments of this invention. Different materials, or combinations thereof, could be used in manufacture of the embodiments. Such materials could include but are not limited to metals, plastics or woods. Manufacturing processes used for the components could include die casting, investment casting, plastic injection molding, forging, machining, wire forming, and others etc. The design could be altered to more or less than five tumblers. The means provided on the locking bar that retains the bottle to the holder could have many embodiments, shapes, or forms. Other language alphabets could be used and the number of combination indexing positions on each tumbler could be greater or less than twenty-six. Thus the scope of the invention should be determined by the appended claims and their legal equivalents, rather than the examples given.

What is claimed is:

1. A combination locking bottle holder comprising:

a base defined by a cylinder with an inside diameter and an outside diameter, an open top end, a closed bottom end, and a circular flange extending radially from the bottom end, the cylinder wall having two formed side channels of nominal width and opposing each other, each of the channels having at least one adjacent longitudinal rib extending outwardly past the cylinder's outside diameter, said longitudinal ribs having a plurality of notches along their length which are disposed at predetermined heights above the cylinder's bottom flange, where said inside diameter of said cylinder with formed channels is of suitable size to accept a bottle;

a locking bar having means for restraining the top end of said bottle to the holder, two legs extending downwardly from said locking bar, both legs having spacing equal to the spacing between the base's channels, said legs being of equal length and of suitable size, shape, and cross-section for acceptance into the channels of said base, a boss feature protruding mid-portion on each leg, said boss features being at the same elevation on their respective legs, beneath the bosses the leg portions having a series of notches disposed at predetermined heights above the bottom end of said legs, where said series of notches on each leg are at corresponding elevations with respect to each others, each leg notch being equal in height to the notches on said base, and length of the notched leg portions being equal to the height of the base's cylindrical portion above the flange and;

an upper ring of annular shape and having an inside diameter sufficiently sized to allow passage of said bottle, bottom surface of said upper ring being planar, said upper ring having an alignment marker feature located on its outer surface, said upper ring having two counterbored openings opposing each other on its periphery; the position of the marker being located at a position midway between the counterbores, said counterbored openings having spacing equal to the spacing between the channels on said base; the openings in the counterbore being sufficiently large enough to allow the passage of the bar's notched legs, the size and depth of each counterbore being adequate to allow said bosses of the bar legs to fully seat; and a plurality of locking tumblers, each being of annular shape and having indicia on external surfaces, each tumbler having an annular locking rib protruding radially inward from the inside surface and which is centered with respect to the tumbler's height, said locking rib having two gaps in its circumference, width of said gaps being just greater than the nominal widths of the base channels and longitudinal rib features, height of said locking rib being just less than the height of the notches in both base and bar, the inside diameter of the tumbler, being defined by the cylindrical surface of said locking rib, is just greater than the outside diameter of the base cylinder whereby:

tumblers with the locking rib gaps placed in angular alignment with and directly over the base channels may be inserted, stacked, and rotatably mounted to the cylindrical portion of said base and are supported by the base's bottom flange, where the sum total height of the tumbler stack is just less than the height of cylindrical portion above the base flange; and said upper ring may be placed on top of and axially aligned with said base and assembled tumblers, where the bottom planar surface of said upper ring rests on and is vertically supported by the top end of said base, where counterbored openings of said upper ring are aligned with and in direct communication with the channels of base; and said bottle may be inserted into said base and be supported by the base's bottom wall and cylindrical portion; and wherein assembled tumblers with locking rib gaps aligned with the base channels and not having any portion of said locking ribs engaged into the channels defines an unlocked condition, whereby in said unlocked condition the notched leg portions of the bar may be fully inserted into the channels and disposed in between the channels and the tumblers; and wherein with bar legs fully assembled, said locking bar is in close proximity to the top end of said bottle, the bar bosses nest and fit into the upper ring counterbores, lower notched portion of legs are disposed in between base channels and tumbler locking ribs, ends of the bar legs are in contact with and vertically supported by base's lower flange, where the marker on said upper ring is in alignment with tumbler indicia, and the tumbler indicia indicate a predetermined unlocking code; and wherein as assembled, the tumbler's inside diameter, as defined by the locking ribs, have a close diametral clearance fit with base cylinder portion, where tumbler locking ribs and notches of base and bar are aligned in elevation and centered in height with respect to each other, where the notches of the base and bar are suitably sized and have close diametral clearance fit to allow free rotation of the tumblers; and wherein as assembled, change in the angular position of any one tumbler from said unlocked condition causes said locking ribs to have engagement between notches of bar and base thus locking and preventing withdrawal of the bar from said base and defines a locked condition; and whereby with the bar in said locked condition, the boss features of the bar prevent removal of said upper ring and tumblers from said base and the bar prevents removal of said bottle from the holder.

2. The combination locking bottle holder of claim 1 one wherein;

said locking tumbler is comprised of an inner ring and an outer ring both having inside and outside diameters and being of equal height, where said inner ring may nest concentrically within said outer ring; and said outer ring has indicia on its external surface and a plurality of recesses cut through its wall, said recesses being equal in number and in angular alignment with said indicia; and said inner ring having a tooth protruding from its outside diameter, said tooth being of size and shape suitable for mating into any recess of said outer ring, said inner ring having a locking rib centered with respect to the inner ring's height, and said locking rib having two opposing gaps in its circumference;

wherein tooth and recess features permit angular indexing between inner and outer rings, and where the position of the open gaps of said locking rib may be adjusted to different angular positions with respect to said indicia; and whereby angular indexing capability permitted between inner and outer rings allows any of said indicia to be used as part of an unlocking code.

3. The combination locking bottle holder of claim 2 wherein:

said outer ring indicia consist of a 26 letter alphabet.

4. The combination locking bottle holder of claim 1 wherein:

said means for restraining the top end of said bottle to the holder comprises a planar wall portion extending generally horizontally from and integrally formed into the top end of said locking bar, said bottle having a closure at its top end, wherein with the bar assembled and locked into the holder, said planar wall portion is in close proximity to the top end of said bottle, where said planar wall portion extends outwardly a substantial distance beyond bottle's closure, whereby said locked bar restricts access to bottle's closure and prevents removal of said bottle from the holder.

5. The combination locking bottle holder of claim 1 wherein:

said means for restraining the top end of said bottle to the holder comprises a cap portion integrally formed at the top of said locking bar, said cap portion being generally cylindrical in form and having a closed top end an open downwardly facing bottom end, said bottle having a closure on its top end, where with the bar assembled and in a locked condition, said cap portion covers and conceal the bottle's closure such that said bottle may not be removed from the holder and the bottle's closure may not be accessed.

6. The combination locking bottle holder of claim 1 wherein:

said means for restraining the top end of said bottle to the holder comprises a curved upper portion of said locking bar that follows, conforms to, and is in close proximity to the upper bottle profile, said bottle having a closure, and said bottle having upside down orientation with said closure being located on the bottom end of said bottle, wherein said bottle is assembled into the holder with the bottom end closure disposed inside of said base and supported by the base's bottom wall, whereby with the bar assembled and in a locked condition, the curved portion of the bar conforming to the upper end of the bottle restrains the bottle and prevents its removal and whereby the bottle closure is inaccessible within said base.

7. The combination locking bottle holder of claim 1 wherein:

said side channels on said base each have two notched longitudinal ribs opposing each other.

8. The combination locking bottle holder of claim 1 where: said indicia on the tumbler consist of a 26 letter alphabet.

* * * * *